United States Patent [19]

Kojima et al.

[11] Patent Number: 4,961,261

[45] Date of Patent: Oct. 9, 1990

[54] ROLL FOR MILL AND METHOD OF MAKING A ROLL FOR A MILL

[75] Inventors: Tatsuo Kojima, Gifu; Tatsunori Kobayashi, Gifu; Kouki Katou, Gifu; Tetsuya Ohba, Muroran; Takashi Yatsuzuka, Muroran; Koji Tanabe, Muroran, all of Japan

[73] Assignees: Nippon Steel Corporation; Mitsubishi Kinzoku Kabushiki Kaisha, both of Japan

[21] Appl. No.: 393,828

[22] Filed: Aug. 14, 1989

Related U.S. Application Data

[63] Continuation of Ser. No. 204,082, Jun. 8, 1988, abandoned.

[30] Foreign Application Priority Data

Jun. 27, 1987 [JP] Japan ..... 62-98739[U]

[51] Int. Cl.[5] ..... B21D 53/00

[52] U.S. Cl. ..... 29/895.21; 29/124; 29/125; 29/136; 72/199; 156/294

[58] Field of Search ..... 29/121.1, 122, 123, 29/124, 125, 130, 148.4 D, 525, 428; 72/199, 237; 100/155 R; 156/294, 295

[56] References Cited

U.S. PATENT DOCUMENTS

| | | | |
|---|---|---|---|
| 3,138,338 | 6/1964 | McKenna | 29/132 |
| 3,718,956 | 3/1973 | Sekimoto et al. | 29/132 |
| 3,787,943 | 1/1974 | Loquist | 29/125 |
| 3,803,683 | 4/1974 | Oxlade | 29/129.5 |
| 3,842,471 | 10/1974 | Polhall et al. | 29/132 |
| 3,861,012 | 1/1975 | Spaeder | 29/129.5 |
| 3,881,233 | 5/1975 | Schmidt et al. | 29/110 |
| 4,415,387 | 11/1983 | Newman | 156/295 |
| 4,601,928 | 7/1986 | Van der Velden | 156/294 |
| 4,624,723 | 11/1986 | Inagumer | 156/294 |
| 4,660,268 | 4/1987 | Evans | 29/124 |

FOREIGN PATENT DOCUMENTS

| | | |
|---|---|---|
| 51-72953 | 6/1976 | Japan . |
| 57-62807 | 4/1982 | Japan . |

*Primary Examiner*—Howard N. Goldberg
*Assistant Examiner*—T. Cuda
*Attorney, Agent, or Firm*—Scully, Scott, Murphy & Presser

[57] ABSTRACT

A roll for a mill includes a roll shaft of a circular cross-section having an axis of rotation therethrough and having an outer peripheral surface. A ring of a wear-resistant material having an outer peripheral surface adapted to engage with a metal material to be rolled is disposed around the roll shaft. A tubular sleeve having an inner peripheral surface is disposed between the roll shaft and the ring with the inner peripheral surface mated with the outer peripheral surface of the roll shaft. A layer of adhesive is interposed between the ring and the sleeve for adhesively securing the ring and the sleeve together. The adhesive layer is compressed by the ring and the sleeve so as to be brought into frictional engagement therewith.

10 Claims, 2 Drawing Sheets

ROLL FOR MILL AND METHOD OF MAKING A ROLL FOR A MILL

This application is a continuation of application Ser. No. 204,082, filed June 8, 1988, now abandoned.

BACKGROUND OF THE INVENTION

1. Field of the Invention

The present invention relates to a roll for a mill in which the strength of bonding between a ring and a roll shaft is highly enhanced.

2. Prior Art

FIGS. 1 to 4 of the accompanying drawings show rolls for a mill hitherto used. One conventional roll shown in FIG. 1, generally designated at A, comprises a roll shaft 100 having a tapered portion 100*a* disposed intermediate opposite ends thereof, a ring 102 of a wear-resistant material disposed around the tapered portion 100*a*, and a tapered tubular sleeve 104 press-fitted between the tapered portion 100*a* and the ring 102. In this roll, the ring 102 is first disposed around the tapered portion 100*a*, and the tapered sleeve 104 is then forced in between the ring 102 and the tapered portion 100*a* by means of a press member 106, so that the sleeve 104 as well as the ring 102 can be rigidly retained in place owing to frictional forces caused between the contact surfaces.

Another conventional roll B shown in FIG. 2 comprises a roll shaft 108 having a tapered portion 108*a* and an internal fluid passageway 110 so formed as to be located adjacent the outer peripheral surface of the tapered portion 108*a*. A pair of collars 112 and 112 and a ring 114 are fitted on the tapered portion 108*a* and fixedly secured thereto by a nut 116 threaded onto the shaft 108. In this roll, the passageway 110 is supplied with oil, and the tapered portion 108*a* is enlarged in diameter owing to pressure of the oil contained in the passageway 110. Hence, the collars 112 and the ring 114 are tightly secured to the shaft 108 not only owing to a fastening force caused by the nut 116 but also owing to the enlargement of the tapered portion 108*a*.

A further conventional roll C shown in FIG. 3 is similar to the roll A in that it comprises a roll shaft 118 having a tapered portion 118*a*, a ring 120 disposed around the tapered portion 118*a*, and a tapered tubular sleeve 122 pressfitted between the tapered portion 118*a* and the ring 120. The roll, however, includes a radially extending bore 124 formed through the shaft 118, a screw member 126 threaded through the shaft 118 so that its forward end protrudes into the bore 124, and a key member 128 passing through the sleeve 122 and received in the bore 124. In this roll, the ring 120 is first disposed around the shaft 118, and the sleeve 122 is then forced in between the ring 120 and the shaft 118 by means of a pressing apparatus 130 as illustrated, and the key member 128 is pressed by the screw member 126 to prevent the sleeve 122 from being unfastened.

A still further conventional roll D shown in FIG. 4 includes a holder 132 fitted on a roll shaft 134, a clamp member 136 fitted on the holder 132 so as to cooperate with it to define a dove-tail groove 138, and a ring 140 fitted in the dove-tail groove 138 and clamped thereto by the clamp member 136. In this roll, the ring 140 is bonded to the holder 132 by an adhesive.

In the rolls A and C, insomuch as there is a clearance between the sleeve and the ring, the pressure exerted between the sleeve and the ring is small in comparison with the pressure exerted between the sleeve and the shaft. As a result, the strength of bonding between the ring and the sleeve is so small that the ring is liable to be shifted due to the torque exerted during the rolling operation. In order to prevent such shifting, the ring has to be made considerably greater in width to obtain a sufficient strength of bonding, so that the roll has the disadvantage that it is high in cost.

Further, in the roll B, since the wear-resistant ring is directly fitted on the shaft, the shaft is susceptible to wear, and hence the strength of bonding of the ring to the shaft is lowered. Besides, insomuch as the inner peripheral surface of the wear-resistant ring has to be processed into a tapered form, the manufacturing cost is increased unduly. Finally, in the roll D, the ring is fixed to the holder only by a bonding force of the adhesive. Accordingly, when the adhesive layer is damaged because of fatigue or the like, the strength of bonding may be suddenly lowered, so that the ring may undergo a slippage which may, in turn, lead to a breakdown.

SUMMARY OF THE INVENTION

It is therefore an object of the present invention to provide a roll for a mill which can be manufactured at a reduced cost and in which a ring is firmly bonded to a roll shaft.

According to the present invention, there is provided a roll for a mill comprising a roll shaft of a circular crosssection having an axis of rotation therethrough and having an outer peripheral surface; a ring of a wear-resistant material disposed around the roll shaft and having an outer peripheral surface adapted to engage with a metal material to be rolled; a tubular sleeve having an inner peripheral surface and disposed between the roll shaft and the ring with the inner peripheral surface being mated with the outer peripheral surface of the roll shaft; and a layer of adhesive interposed between the ring and the sleeve for adhesively securing the ring and the sleeve together, the adhesive layer being compressed by the ring and the sleeve so as to be brought into frictional engagement therewith.

DESCRIPTION OF THE PREFERRED EMBODIMENTS OF THE INVENTION

Various embodiments of the present invention will now be described with reference to FIGS. 5 to 8 of the accompanying drawings.

Figure 5:
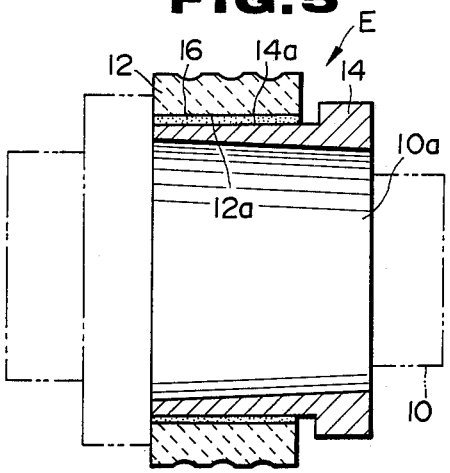
FIG. 5 is a cross-sectional view of a roll for a mill provided in accordance with the present invention.

Referring to FIG. 5, there is shown a roll for use in a mill, generally designated at E, in accordance with the present invention. The roll E comprises a roll shaft 10 of a circular cross-section having an axis of rotation therethrough, a ring 12 of such a wear-resistant material as cemented carbide disposed around the shaft 10, and a tubular sleeve 14 press-fitted between the ring 12 and the shaft 10. The shaft 10 includes a tapered portion 10*a* disposed intermediate opposite ends thereof and having an outer peripheral surface tapering axially of the shaft 10. The ring 12 is disposed around the tapered portion 10*a*, and peripheral grooves, each of which is brought into contacting engagement with a metal material to be rolled, are formed in an outer peripheral surface thereof. The sleeve 14 has an inner tapered surface adapted to be fitted on the tapered portion 10*a* of the shaft 10 and an outer peripheral surface portion 14*a* defined by a cylinder with a uniform diameter. Further, a layer 16 of adhesive or binder is interposed between the sleeve 14 and the ring 12 for adhesively securing the sleeve 14 and the ring 12 together.

For assembling the roll as described above, the ring 12 and the sleeve 14 are first bonded to each other by the adhesive layer 16 interposed therebetween. Self-curing adhesives such as epoxy resin, cyanoacrylate resin and the like may be preferably used for bonding the sleeve and the ring. The adhesive may be applied to either the outer peripheral surface 14*a* of the sleeve 14 or an inner surface 12*a* of the ring 12, or to the both. The adhesive may also be forced into the gap between the sleeve and the ring. In such a case, however, it is preferable to set the viscosity of the adhesive to no greater than around 2,500 cp at 25° C. since the gap is very narrow. The ring 12 and the sleeve 14 thus bonded are firmly joined together to such an extent that they can bear torques 2 to 10 times as large as the torque which the prior art roll can bear. Thereafter, the sleeve 14 with the ring 12 is fitted on the tapered portion 10*a* of the shaft 10, and is forced to move toward a larger-diameter end thereof. Thus, the sleeve 14 is gradually enlarged in diameter to be brought into frictional engagement with the tapered portion 10*a* and tightly secured thereto. The outer peripheral surface of the sleeve 14 thus enlarged compresses the adhesive layer 16 to develop a compressive stress therein, which is, in turn, exerted on the inner surface 12*a* of the ring 12.

In the roll E described above, the ring 12 is firmly bonded to the sleeve 14 not only by the binding force of the adhesive layer 16 but also by the force transmitted from the sleeve 14 through the adhesive layer 16. Besides, the frictional coefficient between the ring 12 and the adhesive layer 16 as well as the frictional coefficient between the sleeve 14 and the adhesive layer 16 is high. Accordingly, even in those cases where the adhesive layer 16 is subjected to fatigue failure, or where its surface should be peeled off, the strength of bonding between the ring 12 and the sleeve 14 is maintained high due to the frictions developed by the above compressive stress. Specifically, in the above embodiment, the internal pressure of 1 to 8 $Kg/mm^2$ is caused by the sleeve. Therefore, if there should not be provided the adhesive layer, the shear strength caused only due to friction would be 0.5 $Kg/mm^2$ on the average. And, the frictional coefficient obtained would be only about 0.1 to 0.15. In the above embodiment, however, the adhesive layer by itself ensures the shear strength of about 1.0 to 2.5 $Kg/mm^2$, and hence the overall shear strength obtained would become about 3.0 to 7.0 $Kg/mm^2$. As a result, the strength of bonding between the ring and the sleeve can be highly enhanced. In addition, the provision of the adhesive layer increases the frictional coefficient to about 0.2 to 0.3. Therefore, even though the strength of bonding caused by the adhesive layer should be lost, the torques would be maintained sufficiently high due to the combination of the internal pressure and the adhesive layer.

Figure 6:
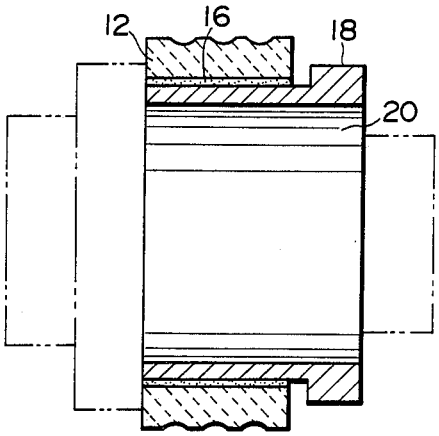
FIG. 6 is a view similar to FIG. 5, but showing a modified roll in accordance with the present invention.

In the roll as described above, the adhesive layer 16 is compressed by press-fitting the tapered sleeve 14 on the tapered portion 10*a* of the shaft 10, but as shown in FIG. 6, a sleeve 18 having an inner surface defined by a cylinder with a uniform diameter may be press-fitted on and fixedly secured to a cylindrical portion with a uniform diameter of a roll shaft 20. For press-fitting the sleeve 18 and the ring 12 on the shaft 20, various methods may be practiced. For example, a shrinkage fit, which comprises the steps of heating the sleeve 18 and the ring 12 and subsequently fitting them on the shaft 20, or a chilling fit, which comprises the steps of chilling the shaft 20 and subsequently fitting the sleeve 18 and the ring 12 thereon, may be applied.

Figure 7:
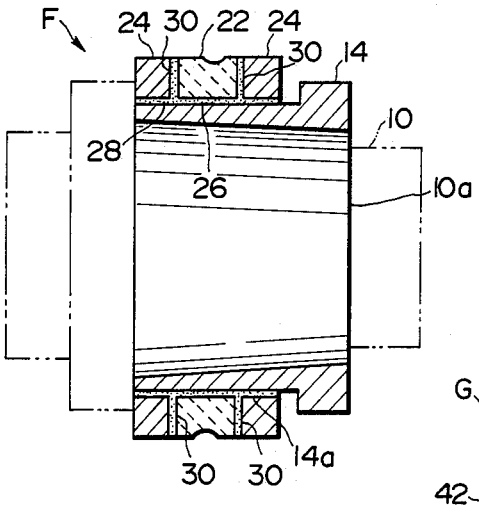
FIG. 7 is a view similar to FIG. 5, but showing another modified roll in accordance with the present invention.

FIG. 7 shows another modified roll for a mill, generally designated at F, in accordance with the present invention. The roll F differs from the roll A of FIG. 5 in that a ring 22, which is smaller in width than the ring 12, and a pair of collars 24 and 24, which are located at the opposite ends of the ring 22, are disposed on the outer peripheral surface portion 14*a* of the sleeve 14 and adhesively secured thereto by a compressed adhesive layer interposed therebetween. The portion of the adhesive layer interposed between the ring 22 and the sleeve 14 will be referred to as a first layer 26 while that portion of the adhesive layer interposed between the collar 24 and the sleeve 14 will be referred to as a second layer 28. Each collar 24 is also bonded to the respective end of the ring 22 by a third layer 30 of adhesive. With this construction, a ring of a small width can be employed without hindrance since the ring is rigidly bonded to the collars 24, too. Accordingly, the width of the ring can be rendered to the minimum, and hence the roll of this construction is very economical.

Figure 1:
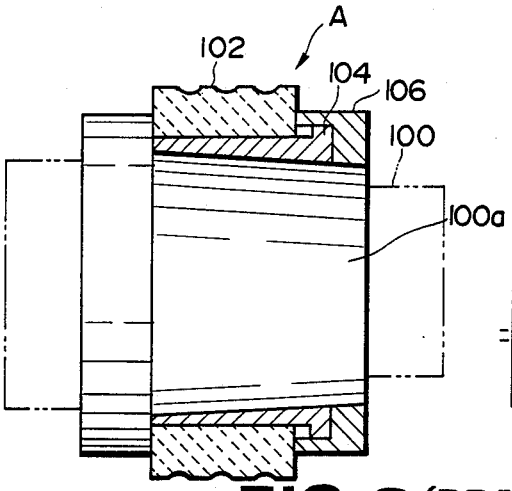
FIG. 1 (PRIOR ART)
FIG. 1 is a cross-sectional view of a conventional roll for a mill.
Figure 2:
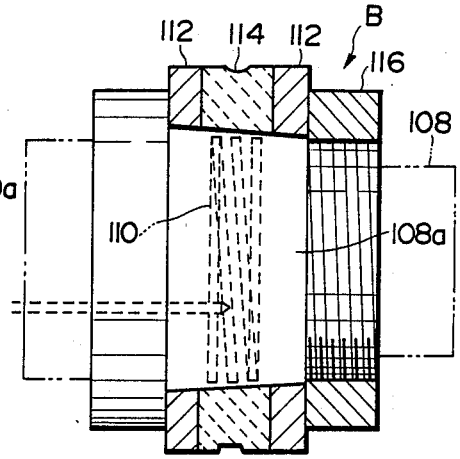
FIG. 2 (PRIOR ART)
FIG. 2 is a view similar to FIG. 1, but showing another conventional roll.
Figure 3:
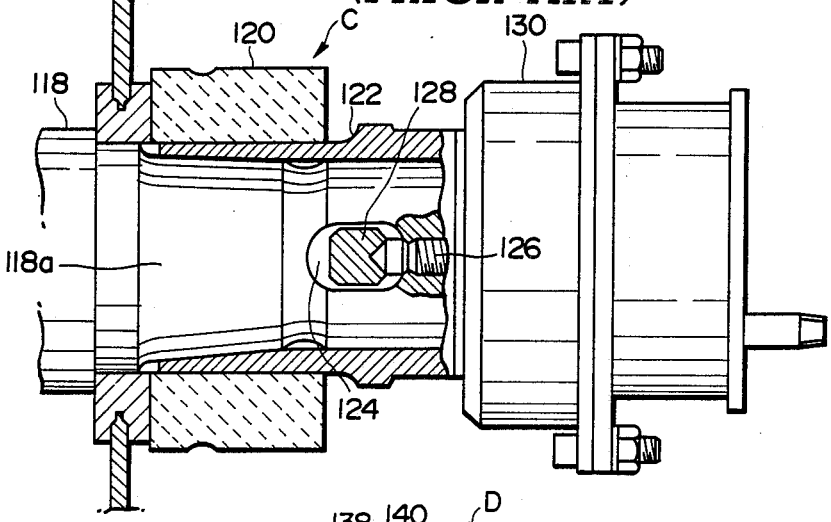
FIG. 3 (PRIOR ART)
FIG. 3 is a view similar to FIG. 1, but showing a further conventional roll.
Figure 4:
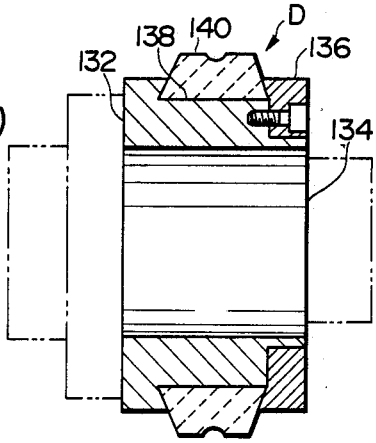
FIG. 4 (PRIOR ART)
FIG. 4 is a view similar to FIG. 1, but showing a still further conventional roll.
Figure 8:
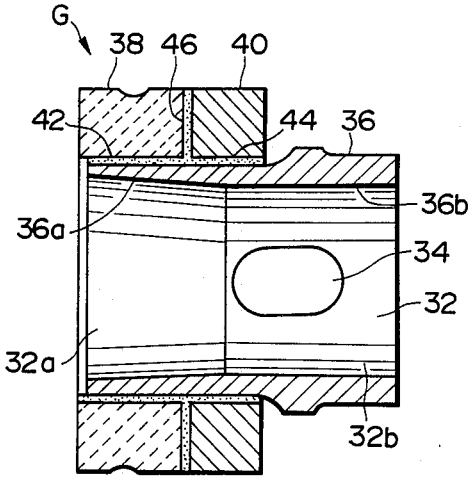
FIG. 8 is a view similar to FIG. 5, but showing a further modified roll in accordance with the present invention.

FIG. 8 shows a further modified roll, designated at G, in accordance with the present invention. The roll G comprises a roll shaft 32 having a tapered portion 32*a* and a cylindrical portion 32*b* extending coaxially from a reduced diameter end of the tapered portion 32*a*. As is the case with the prior art roll C shown in FIG. 3, the shaft 32 includes a radially extending bore 34 formed therethrough for receiving a key member. A sleeve 36, which has an inner peripheral surface comprised of a tapered portion 36*a* and a cylindrical portion 36*b*, is press-fitted on the shaft 32, and a ring 38 and a collar 40 are disposed around the outer peripheral surface of the sleeve 36 and adhesively secured thereto by first and second compressed adhesive layers 42 and 44 interposed therebetween. The ring 38 and the collar 40 are also bonded to each other by a third adhesive layer 46 interposed therebetween.

Further, although in the above embodiments, only one ring is fitted on the sleeve, two or more rings may be fitted thereon in such a manner that each ring is interposed between a pair of collars. In addition, the sleeve may have a tapered outer peripheral surface.

What is claimed is:

1. A roll for a mill comprising:

a roll shaft of a circular cross-section having an axis of rotation therethrough and having an outer peripheral surface including a tapered portion tapering axially of said roll shaft;

a ring of a wear-resistant material disposed around said roll shaft and having an outer peripheral surface adapted to engage with a metal material to be rolled;

a tubular sleeve disposed between said roll shaft and said ring and having an inner surface tapering axially thereof; and a layer of adhesive interposed between said ring and said sleeve and cured to adhesively secure said ring and said sleeve together;

said sleeve being press-fitted on said roll shaft with said inner surface being mated with said tapered portion of said outer peripheral surface of said roll shaft to force said layer of cured adhesive into pressure engagement with said ring and said sleeve.

2. A roll for a mill according to claim 1, further comprising a pair of collars disposed around said sleeve in such a manner that said ring is interposed between said pair of collars, second layers of adhesive interposed between said sleeve and a respective one of said collars for adhesively securing said collar and said sleeve together, third layers of adhesive interposed between said ring and a respective one of said collars for adhesively securing said ring and said collar together.

3. A roll for a mill according to claim 1, further comprising a collar disposed around said sleeve so as to be adjacent said ring, a second layer of adhesive interposed between said collar and said sleeve for adhesively securing said collar and said sleeve, and a third layer of adhesive interposed between said collar and said ring for adhesively securing said collar and said ring, said roll shaft having a cylindrical portion coaxially extending from a reduced-diameter end of said tapered portion, said ring being disposed around said tapered portion of said roll shaft.

4. A roll for a mill, comprising:

a roll shaft of a circular cross-section having an axis of rotation therethrough and having an outer peripheral surface;

a ring of a wear-resistant material disposed around said roll shaft and having an outer peripheral surface adapted to engage with a metal material to be rolled;

a tubular sleeve disposed between said roll shaft and said ring, and having an inner surface mounted on and in secure pressure engagement with the outer peripheral surface of the roll shaft; and a layer of cured adhesive interposed between the ring and the sleeve to adhesively secure the ring and sleeve together, the adhesive layer being cured between the ring and the sleeve prior to the sleeve being brought into said secure pressure engagement with the roll shaft, and wherein the layer of cured adhesive is compressed and brought into frictional engagement with the ring and the sleeve as the sleeve is brought into said secure pressure engagement.

5. A roll according to claim 4, wherein:

the outer surface of the roll shaft includes a tapered portion tapering axially of the roll shaft;

the inner surface of the tubular sleeve tapers axially thereof; and the sleeve is press-fit onto the roll shaft to bring the sleeve into said secure pressure engagement therewith.

6. A method of assembling a roll for a mill comprising the steps of:

(a) providing a roll shaft of a circular cross-section having an axis of rotation therethrough and having an outer peripheral surface including a tapered portion tapering axially of said roll shaft, a ring of a wear-resistant material having an outer peripheral surface adapted to engage with a metal material to be rolled, and a tubular sleeve having an inner surface tapering axially thereof;

(b) disposing said ring around said sleeve and applying adhesive between said ring and said sleeve to cure the adhesive to adhesively secure said ring and said sleeve together; and (c) subsequently press-fitting said sleeve on said roll shaft with said inner surface being mated with said tapered portion of said outer peripheral surface of said roll shaft, to force a layer of the cured adhesive into pressure engagement between said ring and said sleeve.

7. A method of assembling a roll for a mill according to claim 9, further comprising the steps of:

(d) providing a pair of collars;

(e) disposing said pair of collars around said sleeve so as to interpose said ring therebetween; and (f) adhesively securing each collar to said sleeve and said ring by applying adhesive therebetween.

8. A method of assembling a roll for a mill according to claim 6, further comprising the steps of:

(d) providing a collar;

(e) disposing said collar around said sleeve so as to be adjacent to said ring; and (f) adhesively securing said collar to said sleeve and said ring by applying adhesive therebetween.

9. A method of assembling a roll for a mill of the type including a roll shaft of a circular cross section, a ring of a wear-resistant material adapted to engage with a metal material to be rolled, and a tubular sleeve, the method comprising the steps of:

(a) positioning the ring around the sleeve;

(b) applying an adhesive between the ring and the sleeve;

(c) curing the adhesive to adhesively secure the ring and the sleeve together;

(d) after steps (a), (b) and (c), fitting the sleeve on the roll shaft in a secure pressure engagement therewith; and (e) as the sleeve is being fit onto the roll shaft, compressing the cured adhesive between the ring and the sleeve to force the adhesive into frictional engagement with both the ring and the sleeve.

10. A method according to claim 9, wherein:

the roll shaft has an axis of rotation, and an outer peripheral surface including a tapered portion tapering axially of the roll shaft;

the sleeve includes an inner surface tapering axially thereof; and the step of fitting the sleeve on the roll includes the step of press-fitting the sleeve on the roll shaft.

* * * * *